United States Patent [19]

Cycowicz et al.

[11] 4,247,146

[45] Jan. 27, 1981

[54] RECLINER CHAIR WHICH MOVES FORWARDLY RELATIVE TO A WALL AS THE BODY SUPPORTING MEANS OF THE CHAIR MOVES FROM UPRIGHT TO RECLINED POSITIONS

[75] Inventors: Izchak Cycowicz, Brooklyn; Alfred Frimmet, Larchmont, both of N.Y.

[73] Assignee: Mohasco Corp., Amsterdam, N.Y.

[21] Appl. No.: 54,832

[22] Filed: Jul. 5, 1979

Related U.S. Application Data

[63] Continuation of Ser. No. 793,862, May 4, 1977, abandoned, which is a continuation of Ser. No. 618,594, Oct. 2, 1975, abandoned.

[51] Int. Cl.[3] ..... A47C 1/02

[52] U.S. Cl. ..... 297/322; 297/88; 297/89; 297/317; 297/340

[58] Field of Search ..... 297/83, 85 297/88, 89, 80, 61, 68, 90, 91, 322, 317, 340; 248/429; 312/351 NR; 308/316

[56] References Cited

U.S. PATENT DOCUMENTS

| | | | |
|---|---|---|---|
| Re. 28210 | 10/1976 | Re' | 297/83 |
| 1,961,653 | 6/1934 | Van Deest | 248/429 |
| 2,683,481 | 7/1954 | Lorenz | 297/80 |
| 3,243,227 | 3/1966 | Katz | 297/88 |
| 3,316,015 | 4/1967 | Fletcher | 297/89 |
| 3,352,601 | 11/1967 | Cycowicz | 297/85 |
| 3,649,090 | 3/1972 | Dutot | 308/3.6 |
| 3,767,257 | 10/1973 | Rogers, Jr. et al. | 297/85 |
| 3,941,417 | 3/1976 | Re' | 297/85 |
| 3,958,827 | 5/1976 | Re' | 297/85 |

*Primary Examiner*—James T. McCall

*Attorney, Agent, or Firm*—Kirschstein, Kirschstein, Ottinger & Cobrin

[57] ABSTRACT

This chair comprises a chair base having chair side arms on which a body supporting means is tiltably mounted. The chair is constructed to allow the body supporting means to tilt on said base from upright position to said T.V. and fully reclined positions, while the upper end of the backrest portion of said body supporting means, retains its spacing relative to a wall of the room in which the chair is located, while the chair side arms move bodily forwardly away from said wall. The chair arms are swingably mounted on floor engaging base plates, in such manner that the body supporting means can tilt from upright position to fully reclined position, while the chair side arms move forwardly substantially horizontally, being guided by the base plates without side to side movement, first from a rear position of the chair side arms to a forward position projecting forwardly of the base plates, as the body supporting means tilts from upright position to T.V. position, and then moves further forwardly, and projecting further forwardly of the base plates as the body supporting means tilts from T.V. position to fully reclined position. With such construction, sufficient weight of the occupant of the chair is located rearwardly enough to prevent tilting of the front end of the chair side arms downwardly, to maintain the chair side arms in balance, and against tilting or tipping down at its front end.

6 Claims, 5 Drawing Figures

RECLINER CHAIR WHICH MOVES FORWARDLY RELATIVE TO A WALL AS THE BODY SUPPORTING MEANS OF THE CHAIR MOVES FROM UPRIGHT TO RECLINED POSITIONS

This is a continuation of application Ser. No. 793,862 filed May 4, 1977, now abandoned, which in turn is continuation of application Ser. No. 618,954 filed Oct. 2, 1975, now abandoned.

This invention relates to a recliner chair which moves away from a wall as the body supporting means of the chair tilts from upright position to T.V. position and from T.V. position to fully reclined position.

An object of this invention is to provide a chair of the character described in which the body supporting means is swingably mounted on the side arms of the chair and the side arms of the chair are swingably and suspendingly mounted on base plates resting on the floor.

Another object of this invention is to provide a chair of the character described in which the chair side arms move forwardly to project beyond the front ends of the base plates, as the body supporting means tilts from upright to T.V. position, and then moves further forwardly to project further beyond the front ends of the base plates as the body supporting means tilts from T.V. position to fully reclined position.

Yet another object of this invention is to provide a chair of the character described in which the chair arms are so mounted over the base plates that as the chair arms move substantially horizontally forwardly from its rearmost position to its front most position, the chair arms are suspendingly supported on the base plates and guided against side to side sway.

A further object of this invention is to provide a chair of the character described which is so constructed that as the chair side arms move forwardly, the weight of occupant of the chair helps prevent downward tilting of the front end of the chair side arms as the body supporting means moves from T.V. position to fully reclined position.

Still a further object of this invention is to provide a strong, rugged and durable chair of the character which shall be relatively inexpensive to manufacture, easy to manipulate, comfortable to use, and which shall yet be practical and efficient to a high degree.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

IN THE DRAWINGS

Figure 1:
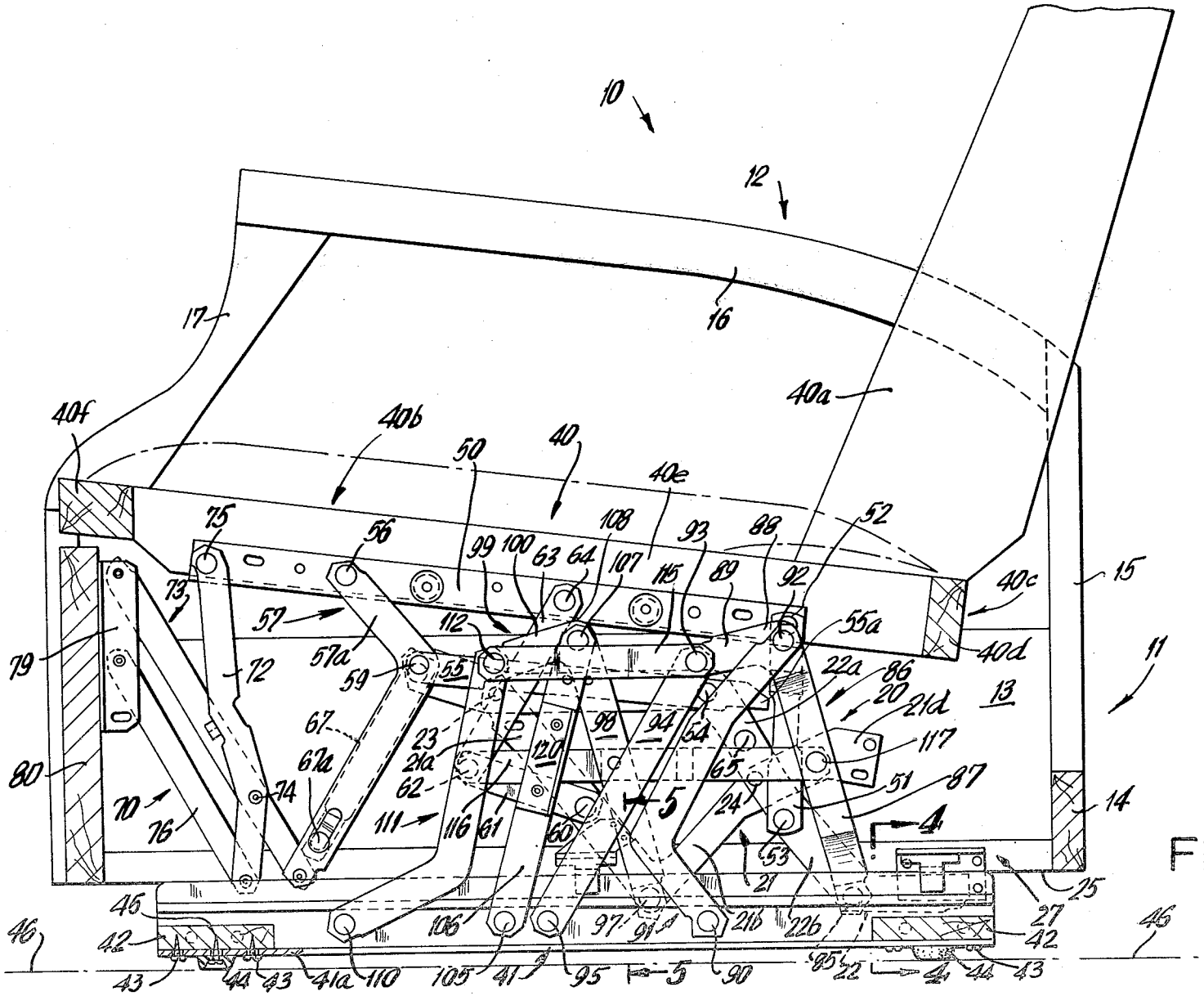
FIG. 1 is an inside elevational view of a far side of a chair embodying the invention, in upright position, with parts in cross-section.

Referring now in detail to the drawing, 10 designates a chair embodying the invention. This chair comprises a movable chair base 11 having side arms 12. Said side arms 12 comprise vertical, parallel side walls 13 interconnected by a rear lower cross-brace 14 and other cross-bracing (not shown), in the well known manner. The side arms may be of usual construction and can include rear posts 15, top arm engaging portions 16 and front brace portions 17 to support portions 16.

FIG. 1 shows the far side of the chair. Since both sides are similar and symmetrically disposed, only one side is shown, and only one side will be described.

Fixed to the inner surface of side wall 13 in any suitable manner, is an arm mounting member 20. Said member 20 comprises a frame mounting link 21 and a hardware mounting link 22, fixed together by a headless pin 23 and a rivet 24. Said frame mounting link 21 is somewhat V-shaped and comprises a forwardly and upwardly inclined arm **21*a* from the lower rear end of which an arm 21*b* inclines upwardly and rearwardly, forming a lower apex 21*c* projecting somewhat below the underside 25 of the base 11 of the chair. The hardware mounting link 22 is somewhat in the shape of an inverted V and comprises a rearwardly and downwardly inclined arm 22*a* crossing arm 21*b* of link 21. Arms 21*b*, 22*a* are riveted by said rivet 24 where they cross. Arm 22*a* extends beyond arm 21*b*, as at 22*b*, to substantially the level of the apex 21*c* of link 21. Arm 21*b* extends beyond arm 22*a*, as at 21*d*. The link 22 further comprises an arm 22*c* extending forwardly from the front upper end of arm 22*a*, forming an apex 22*d*. Arm 22*c* is pinned by said pin 23 to the upper end of arm 21*a* and extends beyond the pin 23, as at 22*e*, which extension is somewhat inclined upwardly and forwardly. Extending rearwardly from the lower rear end of extension 22*b* is a horizontal rearward extension 22*f* terminating short of the rear end of base 11. Fixed to the rear end of arm 22*f* is a rear guide link 27. Said link 27 has a vertical flange 27*a* contacting the outer side of arm 22*f* and pinned thereto by headless pins 28. Extending inwardly from flange 27*a* is a flange 27*b*. Attached to the underside of flange 27*b*, by rivets 29, is a rear guide 30 which may be made of nylon. Said guide 30 has a longitudinal through slot 31** opening to the lower end of the guide for the purpose hereinafter appearing.

Attached to arm **21*a* of link 21, somewhat above the apex 21*c* by rivets 33, is a front link 34 having a vertical flange 34*a* receiving the rivets 33, and a horizontal flange 34*b* at the horizontal level of flange 27*b*. Attached to the underside of flange 34*b* by rivets 35, is a front guide 36 which may be made of nylon. Said front guide 36 is similar to rear guide 30 and has a downwardly opening through slot 37. The slots 31, 37, on each side of the chair, are in a common vertical plane. The inner surfaces of slots 31, 37** may be convexly curved longitudinally to reduce friction, as will be explained later. The front and rear guides are longitudinally aligned at the same levels.

Figure 2:
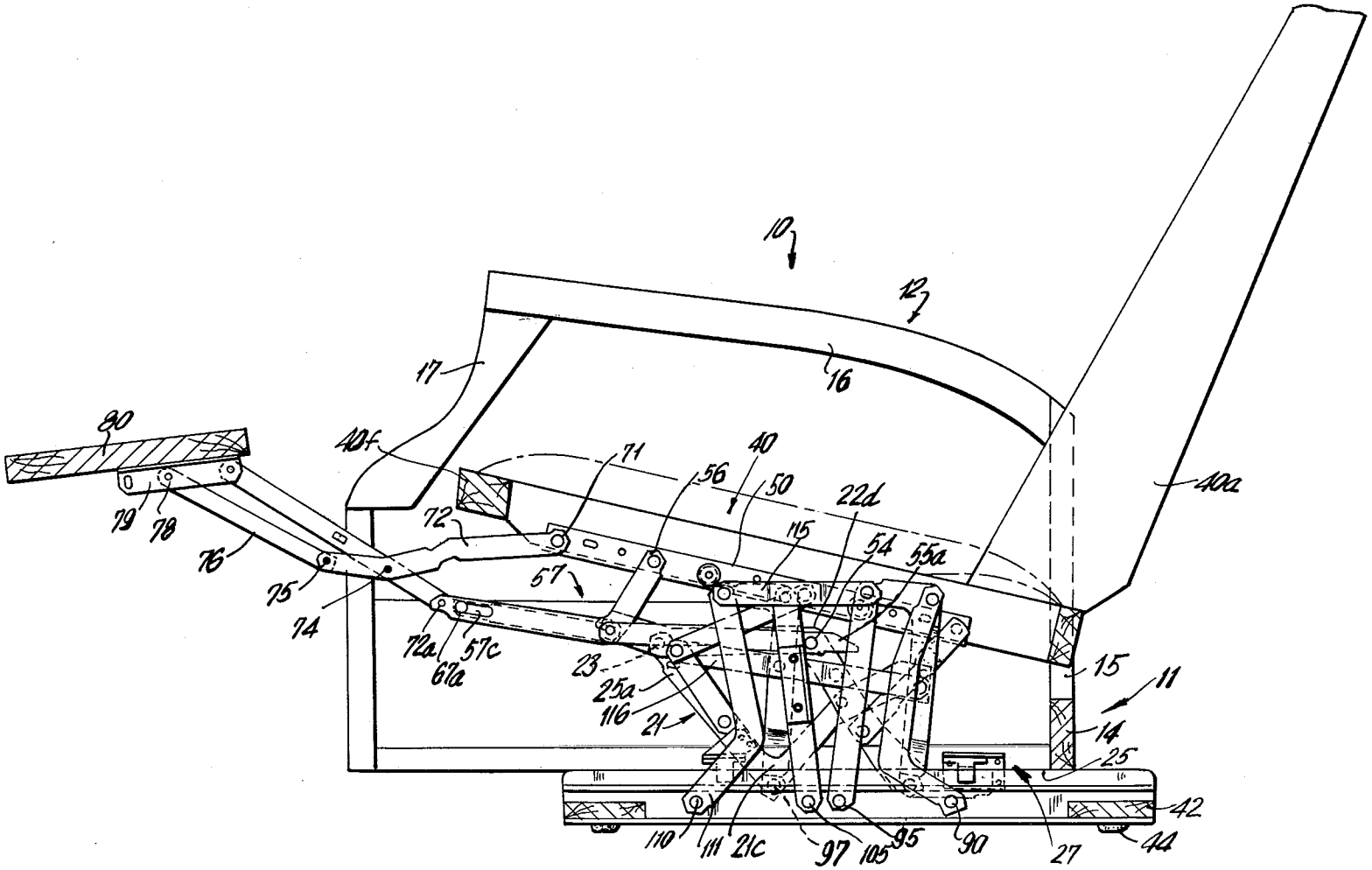
FIG. 2 is a view similar to FIG. 1, but showing the chair in T.V. inclined position.
Figure 3:
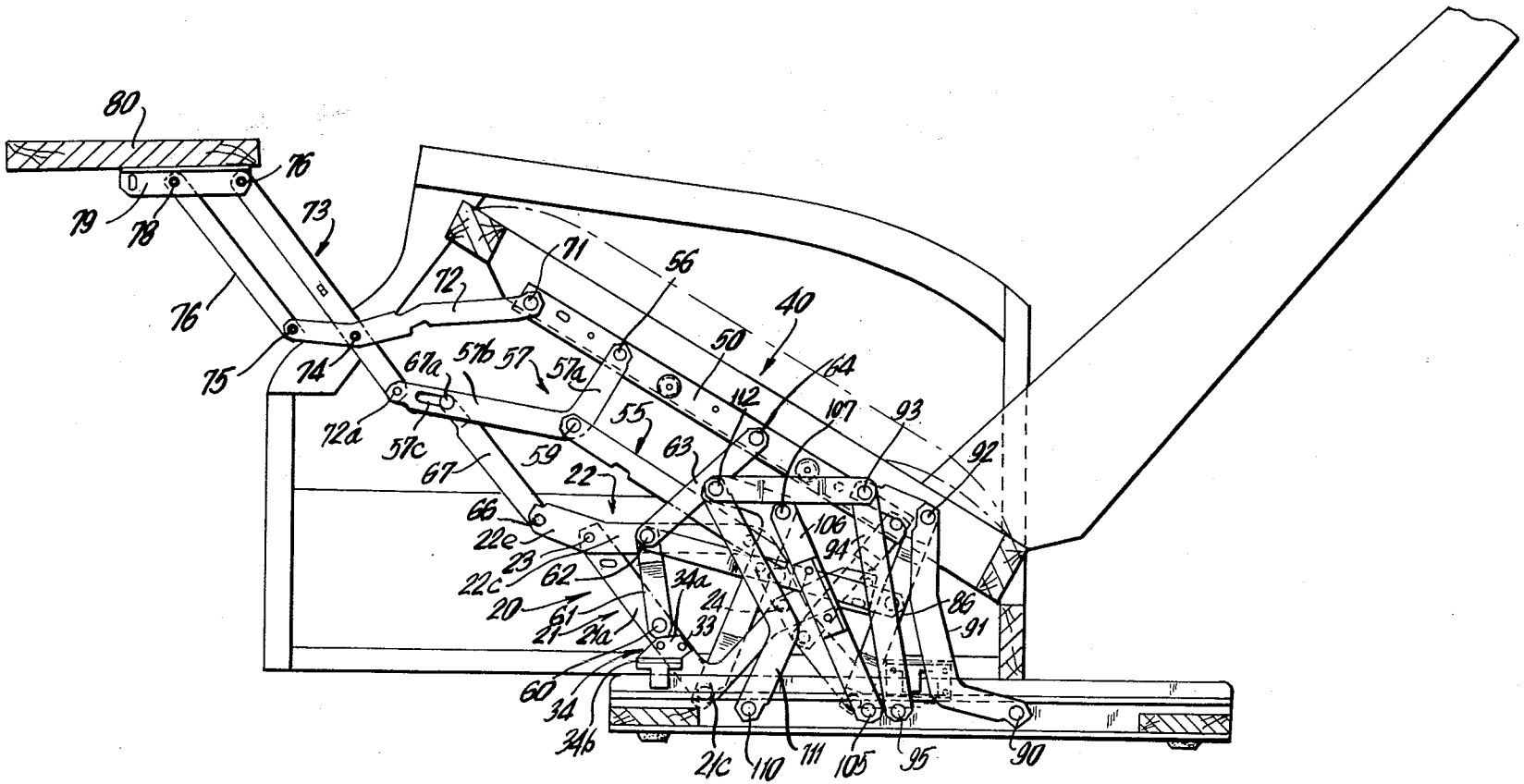
FIG. 3 is a view similar to FIG. 2, but showing the chair in fully reclined position.
Figure 4:
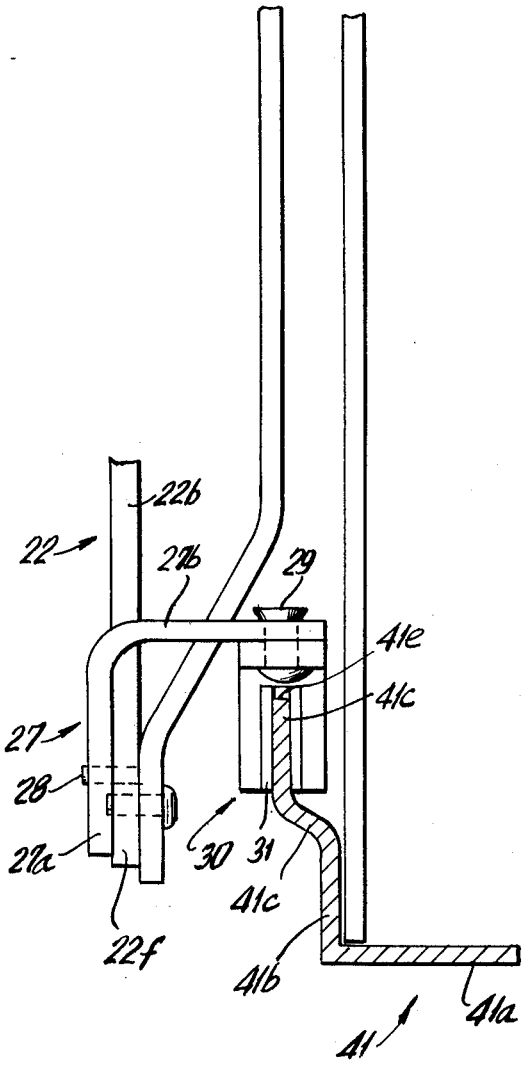
FIG. 4 is a cross-sectional view taken on line 4—4 of FIG. 1.
Figure 5:
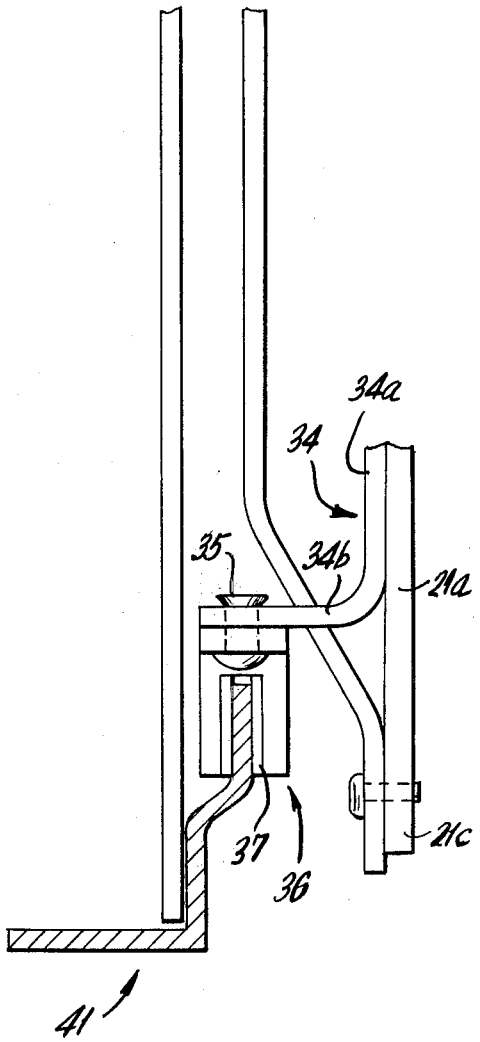
FIG. 5 is a cross-sectional view taken on line 5—5 of FIG. 1.

As will appear hereinafter, means is provided to move the base 11 horizontally forwardly from the upright position of the body supporting member 40 to be described in greater detail hereinafter, as shown in FIG. 1, to the T.V. inclined position thereof shown in FIG. 2 and then to the fully reclined position thereof as illustrated in FIG. 3. To this end, guide rail means is provided to be received in the slots 31, 37 of the guides 30, 36 at each side of the chair. The guide rail means comprises a pair of parallel, similar, symmetrically disposed base plates of which one base plate 41 is shown in the drawing. Base plate 41 is horizontal and comprises an outwardly projecting horizontal lower flange 41*a* running the length of the base plate. Extending up from flange 41*a* is a vertical wall 41*b* formed at its upper end with an outward bend 41*c* from which a vertical flange 41*d* projects upwardly. Said flange 41*d* projects up into slots 31, 37 so that as the base 11 is caused to move, in the manner to be described, the guides 30, 36 may contact opposite sides of the upper vertical flange 41*d*. The flange 41*d* is contacted by the convex inner surfaces of slots 31, 37. The upper edge 41*e* of flange 41*d* does not contact the upper ends of the slots 31, 37.

The two symmetrical coextending base plates 41 at opposite sides of the chair are interconnected by cross braces 42 at opposite ends. Said cross braces contact the ends of flanges 41*a* and are fixed thereto by screws 43. Bumpers 44 are attached to the undersides of flanges 41*a* by screws 45 penetrating the cross braces 42. Said bumpers 44 may be made of rubber, rubber-like or plastic material and contact the floor indicated by line 46. The base plates do not move on the floor, during movement of the body supporting means 40 from upright to fully reclined position and from fully reclined position back to upright position, but are not attached to the floor.

As will be explained more fully hereinafter, the upper end of the backrest portion 40*a* which, in the chair illustrated, is fixed to the seat portion 40*b*, may retain its spacing from a wall of the room in which the chair is located near said wall, while the body support means 40 is moved from upright position to fully reclined position, as the base 11 moves forwardly relatively to the base plate 41.

While the invention has been illustrated as applied to a rester, with seat 40*b* fixed to backrest 40*a*, the invention may also be applied to a lounger in which the backrest can move relative to the seat.

In the form of the invention illustrated in the drawing, the seat comprises a seat frame 40*c* having a rear cross member 40*d* and a pair of side rails 40*e* fixed to the rear cross member as well as to a front cross member 40*f*. In the upright position of the body supporting means 40, the base plates are substantially centered with respect to the chair base 11, with the base projecting equally rearwardly and forwardly of the base plates, as shown in FIG. 1.

Fixed to the inner surface of parallel rails 40*e*, are similar, symmetrical seat links 50. A rear pivot link 51 is pivoted, as at 52 to the rear end of seat link 50 and at its lower end, as at 53, to extension 22*b* of arm 22*a* of link 22, below the rivet 24. Pivoted to the apex 22*d* of link 22, as at 54, is a main pivot lever 55. Pivoted to the seat link 50, as at 56, is a sequence link 57 having an upper arm 57*a* which is inclined upwardly and forwardly in the upright position of the body support means 40, as shown in FIG. 1. Extending from arm 57*a* is a second arm 57*b* which is inclined downwardly and forwardly in the FIG. 1 position of the chair. Arm 57*a* is formed near its lower end, with a longitudinal slot 57*c*. The forward end of the main pivot lever 55 is pivoted, as at 59 to the junction of arms 57*a*, 57*b* of the sequence link 57.

Pivoted to the arm 21*a* of link 21 near the link 34, as at 60, is one end of a short sequence link 61. In the upright position of the body support means, illustrated in FIG. 1, link 61 inclines somewhat upwardly and forwardly. Pivoted to the front end of link 61, as at 62, as a long sequence link 63. The upper end of link 63 is pivoted as at 64, to the seat link 50. In the position of FIG. 1, link 63 inclines upwardly and rearwardly. The pivot 64 is located almost equally between pivots 52 and 56. The main pivot lever 55 has a rear extension 55*a* disposed rearwardly of pivot 54 adapted to contact a headless stop pin 65 on arm 22*a* of link 22, in the fully reclined position of the body support means, as illustrated in FIG. 3 of the drawing.

Pivoted to the forward end of extension 22*e*, as at 66, is one end of a guide link 67. In the upright position of the body support means 40, as shown in FIG. 1, the guide link 67 registers with the leg 57*b* of the sequence link 57 and pivots 66 and 59 are in registry. At the outer end of guide link 67, is a pin 67*a* disposed in slot 57*c* and is located at the lower end of said slot. The guide link 67 and arm 57*b* of sequence link 57 remain in alignment as the body supporting means moves from the upright position thereof (FIG. 1) to the T.V. position thereof (FIG. 2). During such movement, the angle between links 61 and 63 opens up and links 67 and 57 swing, together, in a clockwise direction. In moving from the T.V. position of FIG. 2 to the fully reclined position of FIG. 3, pin 67*a* slides up or rearwardly in slot 57*c* to allow pivot 59 to move upwardly away from pivot 66. Thus, the mechanism must move through the T.V. position before it can move to fully reclined position. Also, with this construction, the mechanism must move through T.V. position when going from fully reclined position to upright position. The contact of extension 55*a* with stop pin 65 prevents the mechanism from going up beyond the fully reclined position.

This chair also has legrest or ottoman mechanism 70 to project a legrest when going from upright to T.V. position, to maintain the legrest in projected position when going from T.V. position to fully reclined position, and from fully reclined position back to T.V. position, and to retract the legrest mechanism when going from T.V. position to upright position. To this end, there is pivoted to the front end of the seat link, as at 71, the upper end of an ottoman or legrest drive link 72. Pivoted to the lower end of arm 57*b* of sequence link 57, as at 72*a*, is one end of an ottoman link 73. Links 72 and 73 cross each other and are interpivoted in crossing relation by a pivot 74. Pivoted to the lower end of link 72, and at 75, is an ottoman link 76. Links 73 and 76 are pivoted as at 77 and 78 respectively, to spaced points of an ottoman angle 79. The ottoman angles 79, on both sides of the chair, are interconnected by a legrest or ottoman 80 which may be upholstered. In the fully retracted position of the legrest mechanism 70, the legrest or ottoman 80 is in vertical position at the front of the chair base, just below the front end of the seat 40*b*, as shown in FIG. 1 of the drawing.

Means is provided to mount the chair base 11 on the base plates 41 for forward and rearward substantially horizontal movement of the chair base from the upright position of the body support means 40 (FIG. 1) to the T.V. position FIG. 2, to project further beyond the front ends of the base plates, with the chair base being maintained in substantially a horizontal position as it is so moved. The mechanism for doing that is so arranged, as will be described hereinafter, that the balance of the chair base is stable when going from upright to T.V. position, and the weight of the occupant of the chair in going from T.V. to fully reclined position, is so distributed on the chair as to counterbalance the weight at the front end of the chair, with rearwardly applied weight of the occupant to prevent the chair from tipping downwardly at its front end when the chair base has been projected a considerable distance beyond the front ends of the base plates. To this end, there is pivoted to arm 22*a* of link 22, at the junction of extension 22*b* and portion 22*f* of said arm, as at 85, the lower end of a swing link 86. Said swing link 86 comprises an arm 87 inclined upwardly and forwardly, in the FIG. 1 position of the chair, to a point close to the pivot 52, to form a junction 88 from which an arm 89 inclines forwardly and downwardly. Pivoted to the base plate, as at 90, is a rear suspension link 91, the upper end of which is pivoted as at 92 to the junction 88 between arms 87 and 89 of swing link 86.

Pivoted to the forward end of arm 89 of swing link 86, as at 93 is the upper end of a rear shift link 94. The lower end of said shift link 94 is pivoted as at 95 to the base plate 41 forwardly of pivot 90.

Pivoted to the junction 21*c* of link 21 as at 97 is the lower end of an arm 98 of a second swing link 99. Said arm 98 of swing link 99 is substantially parallel to arm 87 of swing link 86. Extending from the upper end of arm 98 of swing link 99 is an arm 100 parallel to arm 89 of swing link 86. In fact swing links 86 and 99 are substantially identical and parallel to each other. The pivots 85 and 97 are at the same level.

Pivoted to the base plate 41, as at 105, is one end of a front suspension link 106. The upper end of link 106 is pivoted, as at 107, to the junction 108 of arms 98 and 100 of swing link 99. Pivots 105 and 95 are close together.

Pivoted to the base plate 41, as at 110, is a front shift link 111. The upper end of link 111 is pivoted, as at 112, to the front end of arm 100 of swing link 99. Pivots 112 and 93 are interconnected by a stabilizing link 115. The pivot 62 is connected by a drive link 116 to a pivot 117 disposed substantially equally between the pivot points 92 and 85.

Fixed to link 106, longitudinally thereof is a cross-rail mounting bracket 120. The cross-rail mounting brackets on both sides of the chair are connected by a cross-brace (not shown).

The distance between pivots 110, 112 is same as the distance between pivots 95, 93. The distance between pivots 105, 107 is same as distance between pivots 90, 92. Pivots 110, 105, 95, 90 are at the same level. The distance between pivots 97, 107 is same as the distance between pivots 85, 92. Pivots 97 and 85 are at the same level. Links 86 and 99 are similar.

To move the chair from upright to reclined positions, the occupant holds the arms 16 and pushes back against the backrest 40*a*. To move from reclined position to upright position, the occupant presses his feet down on the ottoman or legrest 80.

The chair base 11 is supported through the links 86 and 99 pivoted to the arm mounting frame 20 at 85 and 97, respectively, and links 91 and 106 pivoted to the base plate 41 at 90 and 105, respectively.

The occupant of the chair sitting on the body support means 40 in upright position of FIG. 1, grasps the arm 16 and pushes back on the backrest 40*a*, causing the chair base 11 to first move from upright position of FIG. 1 to T.V. position of FIG. 2, and then from T.V. position of FIG. 2, to the fully reclined position of FIG. 3. The chair base 11 moves in a slight arc, almost horizontally. In moving the chair base 11 from rear to front, the arc, goes down, then up, then down, then up, but only slightly, close to a straight horizontal line. The chair base never touches the upper edges of the base plates. The guides only keep the chair base from moving side to side.

As the body support means 40 moves back and its front end tilts upwardly, due to the arrangement of the linkages, the chair base 11 moves forwardly from the position of FIG. 1 to the position of FIG. 2 and then from the position of FIG. 2 to the position of FIG. 3.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

As the body supporting member 40 tilts back from upright sitting position of FIG. 1 to the T.V. position of FIG. 2, the drive link 116 pulls the lower end of the swing link 86 forwardly to pull the chair base 11 forwardly of the base plate 41 from the FIG. 1 position of the chair base to the FIG. 2 position thereof.

Further tilting of the seat link from position of FIG. 2 to the fully reclined position of FIG. 3 causes the lower end of the seat link 86 to swing further forwardly to move the chair base 11 to the FIG. 3 position thereof.

In T.V. position and fully reclined position, the weight of the occupant on the body supporting member 40 prevents the chair base 11 from moving backward relative to the base plate 41.

We claim:

1. In a wall-proximity reclining chair of the type having (A) a stationary base for supporting the chair on a floor;

(B) body-supporting means including a seat located generally above the base, and a backrest located generally rearwardly of the seat; and (C) a movable armrest assembly including (1) a pair of armrests each located at an opposite side of the seat, each armrest having an outer wall which faces away from the seat, and a generally vertically-extending inner wall which faces towards the seat, both inner walls extending downwardly at opposite sides of the seat to thereby bound a lower chair region underneath the seat, (2) means for interconnecting the armrests for joint movement, and (3) means for mounting the interconnected armrests for longitudinal generally horizontal reciprocating movement relative to the base to thereby forwardly and rearwardly move the armrest assembly relative to the base in response to manual urging on the armrests by a seated user;

the improvement comprising:

(a) a base-mounting member mounted at each opposite side of the base in the lower chair region;

(b) a seat-mounting member mounted at each opposite side of the seat;

(c) an armrest-mounting member mounted only on the inner wall of each armrest in the lower chair region below the seat but above the base; and (d) an integrated all-linkage system at each side of the seat and operative for displacing the body-supporting means between an end-limiting upright position in which the seat and backrest are spaced at a predetermined distance away from a room wall behind the chair, and are oriented at a predetermined orientation relative to the base, and an end-limiting fully reclined position in which the seat is linearly spaced at a greater forward distance away from the room wall such that physical contact of the body-supporting means with the room wall is avoided, and in which the seat and the backrest are oriented at a different inclined orientation relative to the base, (i) each all-linkage system constituting a plurality of interconnected links all displaceable in response to said longitudinal movement of the armrest assembly, for simultaneously effecting both the linear and the inclined displacement of the body-supporting means without mechanical interference by any of the links with each other, (ii) each plurality of interconnected links being connected at each side of the chair between the seat-mounting member, its respectively-associated base-mounting member and its respectively-associated armrest-mounting member, all of said mounting members and links being located and mounted only on the inner wall of the respectively-associated armrest, (iii) all of said interconnected links of each system together with its associated mounting members all constituting a unitary linkage mechanism which, when not mounted on an armrest inner wall, is liftable and movable as a unit and which is positionable as a whole on the respective inner wall of an armrest for assembly thereat in one assembly operation.

2. The improvement as defined in claim 1, wherein each all-linkage system includes a front four-bar linkage sub-system and a rear four-bar linkage sub-system; each sub-system having an elongated front shift first bar having a lower end pivotally mounted on the base-mounting member, and an upper pivot point; and each sub-system including an elongated rear suspension second bar having a lower end pivotally mounted on the base-mounting member, and an upper end; and each sub-system including an elongated top third bar having its opposite ends pivotally connected between each upper pivot point of the first bar and the respective upper end of the second bar; said lower ends of said first and second bars being spaced lengthwise of the base-mounting member and constituting the fourth bar; both of said four-bar sub-systems being configurated such that their upper pivot points do not move relative to each other during said movement of the armrest assembly; and further comprising an elongated stabilizing link having its opposite ends pivotally connected between the upper pivot points of said sub-systems, said stabilizing link extending lengthwise between said sub-systems and serving to resist deformation and twisting about a vertical axis to thereby prevent undesirable instability in the chair.

3. The improvement as defined in claim 1; and further comprising anti-side sway means on each armrest-mounting member for allowing only limited side-to-side movement of each armrest-mounting member relative to its associated base-mounting member at the same side of the chair, during the forward and rearward movement of the armrest assembly.

4. The improvement as defined in claim 3, wherein said anti-side sway means includes at each side of the chair a channel guide having a pair of arms spaced transversely apart of each other to thereby define a channel therebetween, and wherein each base-mounting member includes an upright flange receivable with clearance in the channel to thereby permit limited side-to-side movement of the channel guide.

5. In a wall-proximity reclining chair of the type having (A) a stationary base for supporting the chair on a floor;

(B) body-supporting means including a seat located generally above the base, and a backrest located generally rearwardly of the seat; and (C) a movable armrest assembly including (1) a pair of armrests each located at an opposite side of the seat, each armrest having an outer wall which faces away from the seat, and a generally vertically-extending inner wall which faces towards the seat, both inner walls extending downwardly at opposite sides of the seat to thereby bound a lower chair region underneath the seat, (2) means for interconnecting the armrests for joint movement, and (3) means for mounting the interconnected armrests for longitudinal generally horizontal reciprocating movement relative to the base to thereby forwardly and rearwardly move the armrest assembly relative to the base in response to manual urging on the armrests by a seated user;

the improvement comprising:

(a) a base-mounting member mounted at each opposite side of the base in the lower chair region;

(b) a seat-mounting member mounted at each opposite side of the seat;

(c) an armrest-mounting member mounted only on the inner wall of each armrest in the lower chair region below the seat but above the base; and (d) an integrated all-linkage system at each side of the seat and operative for displacing the body-supporting means between an end-limiting upright position in which the seat and backrest are spaced at a predetermined distance away from a room wall behind the chair, and are oriented at a predetermined orientation relative to the base, and an end-limiting fully reclined position in which the seat is linearly spaced at a greater forward distance away from the room wall such that physical contact of the body-supporting means with the room wall is avoided, and in which the seat and the backrest are oriented at a different inclined orientation relative to the base, (i) each all-linkage system constituting a plurality of interconnected links all displaceable in response to said longitudinal movement of the armrest assembly, for simultaneously effecting both the linear and the inclined displacement of the body-supporting means without mechanical interference by any of the links with each other, (ii) each all-linkage system including a front four-bar linkage sub-system and a rear four-bar linkage sub-system, each sub-system having an elongated front shift first bar having a lower end pivotally mounted on the base-mounting member, and an upper pivot point, and each sub-system including an elongated rear suspension second bar having a lower end pivotally mounted on the base-mounting member, and an upper end, and each sub-system including an elongated top third bar having its opposite ends pivotally connected between each upper pivot point of the first bar and the respective upper end of the second bar, said lower ends of said first and second bars being spaced lengthwise of the base-mounting member and constituting a fourth bar, both of said four-bar sub-systems being configurated such that their upper pivot points do not move relative to each other during said movement of the armrest assembly and including an elongated stabilizing link having its opposite ends pivotally connected between the upper pivot points of said sub-systems, said stabilizing link extending lengthwise between said sub-systems and serving to resist deformation and twisting about a vertical axis to thereby prevent undesirable instability in the chair, (iii) each plurality of interconnected links being connected at each side of the chair between the seat-mounting member, its respectively-associated base-mounting member and its respectively associated armrest-mounting member, all of said mounting members and links being located and mounted only on the inner wall of the respectively-associated armrest, (iv) all of said interconnected links of each system together with its associated mounting members all constituting a unitary linkage mechanism which, when not mounted on an armrest inner wall, is liftable and movable as a unit and which is positionable as a whole on the respective inner wall of an armrest for assembly thereat in one assembly operation.

6. The improvement as defined in claim 1; and further comprising means mounted on one of said links at one side of the chair at an elevated location above the base and below the seat, for permitting the all-linkage systems at opposite sides of the chair to be interconnected for joint movement.

* * * * *